US007198542B2

(12) United States Patent
Kramer et al.

(10) Patent No.: US 7,198,542 B2
(45) Date of Patent: Apr. 3, 2007

(54) METHOD AND SYSTEM FOR CONTROLLING THE CHEMICAL MECHANICAL POLISHING BY USING A SEISMIC SIGNAL OF A SEISMIC SENSOR

(75) Inventors: Jens Kramer, Dresden (DE); Thomas Gyulai, Ullersdorf (DE); Arwed Reichel, Senftenberg (DE)

(73) Assignee: Advanced Micro Devices, Inc,, Austin, TX (US)

( * ) Notice: Subject to any disclaimer, the term of this patent is extended or adjusted under 35 U.S.C. 154(b) by 0 days.

(21) Appl. No.: 10/987,804

(22) Filed: Nov. 12, 2004

(65) Prior Publication Data

US 2005/0142987 A1 Jun. 30, 2005

(30) Foreign Application Priority Data

Dec. 30, 2003 (DE) ..... 103 61 636

(51) Int. Cl.
*B24B 49/10* (2006.01)

(52) U.S. Cl. ..... 451/5; 451/41; 451/21

(58) Field of Classification Search ..... 451/5, 451/21, 443, 444, 72, 56, 287, 288
See application file for complete search history.

(56) References Cited

U.S. PATENT DOCUMENTS

| | | | | |
|---|---|---|---|---|
| 5,222,329 | A * | 6/1993 | Yu | 451/11 |
| 5,904,608 | A * | 5/1999 | Watanabe | 451/5 |
| 5,904,609 | A | 5/1999 | Fukuroda et al. | 451/49 |
| 6,288,648 | B1 * | 9/2001 | Easter et al. | 340/635 |
| 6,306,008 | B1 * | 10/2001 | Moore | 451/5 |
| 6,431,953 | B1 * | 8/2002 | Carter et al. | 451/5 |
| 6,561,875 | B1 * | 5/2003 | Homma et al. | 451/41 |
| 6,722,948 | B1 * | 4/2004 | Berman | 451/21 |
| 6,835,116 | B2 * | 12/2004 | Oguri et al. | 451/8 |
| 6,896,583 | B2 * | 5/2005 | Rodriquez et al. | 451/5 |
| 6,905,571 | B2 * | 6/2005 | Sakuma et al. | 156/345.13 |

* cited by examiner

*Primary Examiner*—Robert A. Rose
(74) *Attorney, Agent, or Firm*—Williams, Morgan & Amerson, P.C.

(57) ABSTRACT

In a system and a method according to the present invention, a seismic signal from a seismic sensor coupled to a drive assembly of a pad conditioning system is used to estimate the status of one or more consumables in a CMP system.

13 Claims, 3 Drawing Sheets

METHOD AND SYSTEM FOR CONTROLLING THE CHEMICAL MECHANICAL POLISHING BY USING A SEISMIC SIGNAL OF A SEISMIC SENSOR

BACKGROUND OF THE INVENTION

1. Field of the Invention

The present invention relates to the field of fabrication of microstructures, and, more particularly, to a tool for chemically mechanically polishing (CMP) substrates, bearing, for instance, a plurality of dies for forming integrated circuits, wherein the tool is equipped with a conditioner system for conditioning the surface of a polishing pad of the tool.

2. Description of the Related Art

In microstructures such as integrated circuits, a large number of elements, such as transistors, capacitors and resistors, are fabricated on a single substrate by depositing semiconductive, conductive and insulating material layers and patterning those layers by photolithography and etch techniques. Frequently, the problem arises that the patterning of a subsequent material layer is adversely affected by a pronounced topography of the previously formed material layers. Moreover, the fabrication of microstructures often requires the removal of excess material of a previously deposited material layer. For example, individual circuit elements may be electrically connected by means of metal lines that are embedded in a dielectric, thereby forming what is usually referred to as a metallization layer. In modem integrated circuits, a plurality of such metallization layers is typically provided, wherein the layers are stacked on top of each other to maintain the required functionality. The repeated patterning of material layers, however, creates an increasingly non-planar surface topography, which may cause deterioration of subsequent patterning processes, especially for microstructures including features with minimum dimensions in the sub-micron range, as is the case for sophisticated integrated circuits.

It has thus turned out to be necessary to planarize the surface of the substrate between the formation of specific subsequent layers. A planar surface of the substrate is desirable for various reasons, one of them being the limited optical depth of the focus in photolithography, which is used to pattern the material layers of microstructures.

Chemical mechanical polishing (CMP) is an appropriate and widely used process to remove excess material and to achieve global planarization of a substrate. In the CMP process, a wafer is mounted on an appropriately formed carrier, a so-called polishing head, and the carrier is moved relative to a polishing pad while the wafer is in contact with the polishing pad. A slurry is supplied to the polishing pad during the CMP process and contains a chemical compound reacting with the material or materials of the layer to be planarized by, for example, converting into a reaction product that may be less stable and easier removed, while the reaction product, such as a metal oxide, is then mechanically removed with abrasives contained in the slurry and/or the polishing pad. To obtain a required removal rate while at the same time achieving a high degree of planarity of the layer, parameters and conditions of the CMP process must appropriately be chosen, thereby considering factors such as, construction of the polishing pad, type of slurry, pressure applied to the wafer while moving relative to the polishing pad, and the relative velocity between the wafer and the polishing pad. The removal rate further significantly depends on the temperature of the slurry, affected by the amount of friction created by the relative motion of the polishing pad and the wafer, the degree of saturation of the slurry with ablated particles and, in particular, the state of the polishing surface of the polishing pad.

Most polishing pads are formed of a cellular microstructure polymer material having numerous voids which are filled with slurry during operation. A densification of the slurry within the voids occurs due to the absorbed particles that have been removed from the substrate surface and accumulated in the slurry. As a consequence, the removal rate steadily decreases, thereby disadvantageously affecting the reliability of the planarizing process and thus reducing yield and reliability of the completed semiconductor devices.

To partly overcome this problem, typically a so-called pad conditioner is used that "reconditions" the polishing surface of the polishing pad. The pad conditioner includes a conditioning surface that may be comprised of a variety of materials, e.g., diamond that is embedded in a resistant material. In such cases, the exhausted surface of the pad is ablated and/or reworked by the relatively hard material of the pad conditioner once the removal rate is assessed to be too low. In other cases, as in sophisticated CMP apparatus, the pad conditioner is continuously in contact with the polishing pad while the substrate is polished.

In modern integrated circuits, process requirements concerning uniformity of the CMP process are very strict so that the state of the polishing pad has to be maintained as constant as possible over the entire area of a single substrate as well as for the processing of as many substrates as possible. Consequently, the pad conditioners are usually provided with a drive assembly and a control unit that allow the pad conditioner, that is at least a carrier including the conditioning surface, to be moved with respect to the polishing head and the polishing pad to rework the polishing pad substantially uniformly while avoiding interference with the movement of the polishing head. Therefore, one or more electric motors are typically provided in the conditioner drive assembly to rotate and/or sweep the conditioning surface suitably.

One problem with conventional CMP systems resides in the fact that consumables, such as the conditioning surface, the polishing pad, components of the polishing head, slurry batches and the like, have to be replaced on a regular basis. For instance, diamond-comprising conditioning surfaces may typically have lifetimes of less than 2,000 substrates, wherein the actual lifetime depends on various factors that make it very difficult to predict the appropriate time for replacement. Generally, replacing the consumables at an early stage significantly contributes to the cost of ownership and reduced tool availability, whereas a replacement in a very advanced stage of one or more of the consumables of a CMP system may jeopardize process stability. Moreover, the deterioration of the consumables renders it difficult to maintain process stability and to reliably predict an optimum time point for consumable replacement.

In view of the above-mentioned problems, there exists a need for an improved control strategy in CMP systems, wherein the behavior of consumables is taken into account.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the present invention is directed to a technique for controlling a CMP system on the basis of a signal representing the status of a drive assembly coupled to a pad conditioner, wherein the signal, for instance provided by the drive assembly itself, may be used to indicate the current tool status and/or to estimate a remaining lifetime of one or more consumables of the CMP system and/or to improve the quality of the CMP process control. To this end, the signal delivered by the drive assembly of the pad conditioner and/or any other signal provided by a "probe" being in contact with the polishing pad, continuously or intermittently, may serve as a "sensor" signal containing information on the current status of the conditioning surface, which may in turn be assessed for predicting the lifetime and/or re-adjust one or more process parameters of the CMP process. Since the frictional force created by the relative motion between a conditioning surface and a polishing pad is substantially independent from substrate specific characteristics, contrary to the frictional force between a substrate and the polishing pad, any signal indicative of this frictional force may efficiently be employed for estimating the status of the conditioning surface. According to the present invention, the drive assembly of the pad conditioner and/or any other appropriate mechanical probe is used as a source for generating a signal indicating the frictional force, thereby serving as a "status" sensor of at least the conditioning surface of the pad conditioner.

According to one illustrative embodiment of the present invention, a system for chemical mechanical polishing comprises a controllably movable polishing head configured to receive and hold in place a substrate. A polishing pad is mounted on a platen that is coupled to a drive assembly. The system further comprises a pad conditioning assembly and a seismic sensor disposed to detect a vibration in at least one of the polishing pad and the pad conditioning assembly, wherein the seismic sensor is configured to supply a seismic signal indicative of the vibration.

In accordance with still another illustrative embodiment of the present invention, a method of operating a CMP system comprises obtaining a seismic signal from a seismic sensor of the CMP system, wherein the seismic sensor is positioned to detect, at least temporarily, a vibration in at least one of a polishing pad and a pad conditioner of the CMP system. Moreover, a status of at least one consumable member of the CMP system is estimated on the basis of the seismic signal.

According to yet another illustrative embodiment of the present invention, a method of estimating a lifetime of consumables in a CMP system comprises determining the status of a first conditioning surface of a pad conditioner at a plurality of time points while using the first conditioning surface under predefined operating conditions. Then, a relationship is established between the status determined for each time point and a seismic signal indicating at least one of a vibration in a polishing pad and a contact surface of a probe that is at least temporarily in contact with the polishing pad. Finally, the seismic signal is assessed when operating the CMP system under the predefined operating conditions with a second conditioning surface on the basis of the relationship to estimate a remaining lifetime of at least one consumable member of the CMP system.

In accordance with still a further illustrative embodiment, a method of controlling a process sequence including a CMP process comprises obtaining a seismic signal from a seismic sensor attached to a CMP system. The seismic signal is indicative of a vibration in at least one of a polishing pad and a contact surface of a probe that is at least temporarily in contact with the polishing pad. Additionally, the method comprises adjusting at least one process parameter in the process sequence on the basis of the seismic signal.

BRIEF DESCRIPTION OF THE DRAWINGS

The invention may be understood by reference to the following description taken in conjunction with the accompanying drawings, in which like reference numerals identify like elements, and in which.

Figure 1:
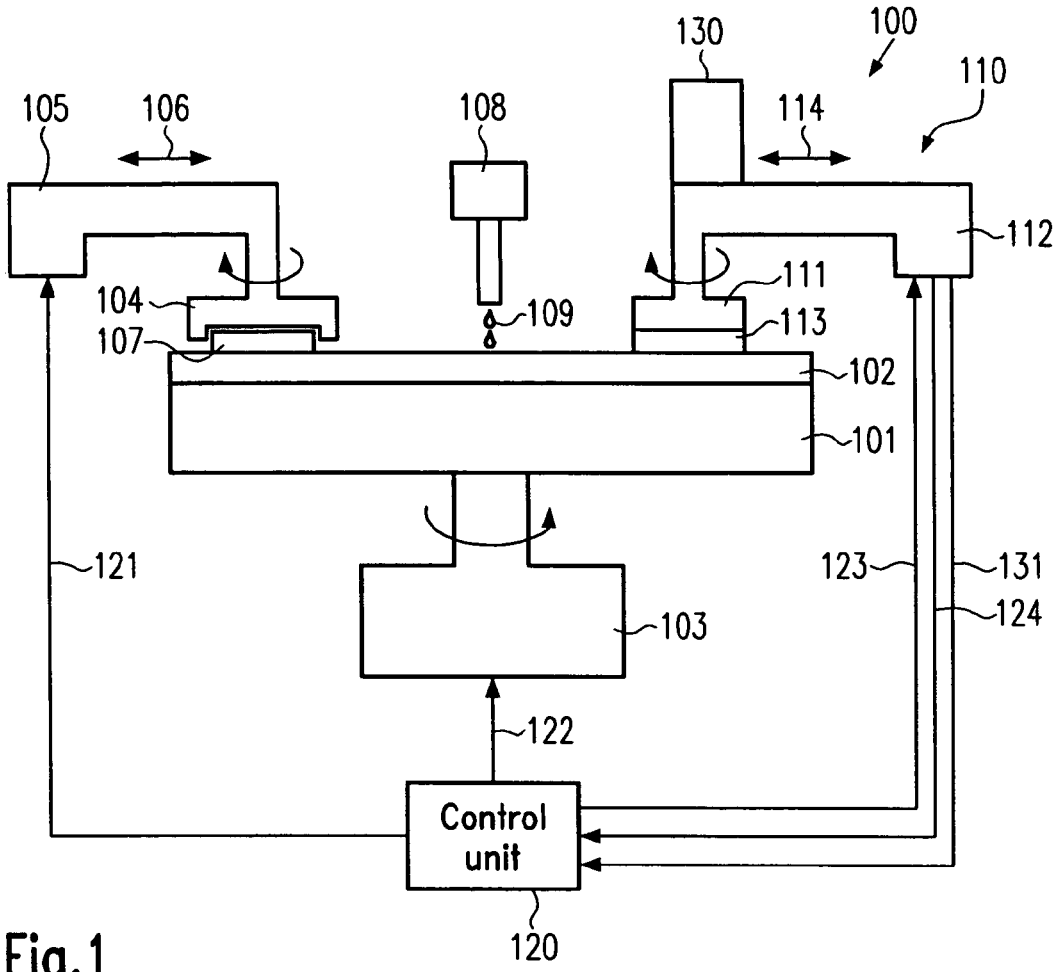
FIG. 1 shows a sketch of a CMP system according to illustrative embodiments of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

With reference to the drawings, further illustrative embodiments of the present invention will now be described in more detail. FIG. 1 schematically represents a CMP system 100 in accordance with the present invention. The CMP system 100 comprises a platen 101, on which a polishing pad 102 is mounted. The platen 101 is rotatably attached to a drive assembly 103 that is configured to rotate the platen 101 at any desired revolution in a range of zero to some hundred revolutions per minute. A polishing head 104 is coupled to a drive assembly 105, which is adapted to rotate the polishing head 104 and to move it radially with respect to the platen 101 as is indicated by 106. Furthermore, the drive assembly 105 may be configured to move the polishing head 104 in any desired manner necessary to load and unload a substrate 107, which is received and held in place by the polishing head 104. A slurry supply 108 is provided and positioned such that a slurry 109 may appropriately be supplied to the polishing pad 102.

The CMP system 100 further comprises a conditioning system 110 which will also be referred to hereinafter as a pad conditioner 110 including a head 111 attached to which is a conditioning member 113 including a conditioning surface comprised of an appropriate material, such as diamond, having a specified texture designed to obtain an optimum conditioning effect on the polishing pad 102. The head 111 is connected to a drive assembly 112, which, in turn, is configured to rotate the head 111 and/or move it radially with respect to the platen 101 as is indicated by the arrow 114. Moreover, the drive assembly 112 may be configured to provide the head 111 with any movability required for yielding the appropriate conditioning effect.

The drive assembly 112 comprises at least one motor, typically an electric motor, of any appropriate construction to impart the required functionality to the pad conditioner 110. For instance, the drive assembly 112 may include any type of DC or AC servo motor. Similarly, the drive assemblies 103 and 105 may be equipped with one or more appropriate electric motors.

The CMP system 100 further comprises a seismic sensor 130 that is disposed in the CMP system 100 to enable the detection of vibrations in the polishing pad 102 and/or in a probing surface that may be brought into contact with the polishing pad. In one particular embodiment, the conditioner 110 may serve as a probe for detecting vibrations, wherein the conditioning surface of the member 113 serves as the probing surface. In other embodiments, a separate probe may be provided, which is advantageously positioned near the member 113 to preferably detect vibrations created by the interaction of the member 113 with the polishing pad 102. The seismic sensor 130 may comprise an acceleration sensor and/or a speed sensor and/or a pressure sensor or any other means that provides a signal in response to a vibration. Typical acceleration sensors or pressure sensors provide a seismic signal for vibrations within a frequency range of approximately 0.1 Hz or less to several kHz, wherein a sensitivity may range for presently available acceleration sensitive devices from about 500 mV/g (1 g=9.81 m/s$^2$) to about 10000 mV/g. Depending on the size of the seismic sensor 130, it may be directly positioned close to the probing surface, or it may be mechanically coupled thereto. For instance, the seismic sensor may be attached to the member 113, to the head 111 or to a support arm of the drive assembly 112.

The CMP system may further comprise a control unit 120, which is operatively connected to the drive assemblies 103, 105 and 112, and in one particular embodiment to the seismic sensor 130. The control unit 120 may also be connected to the slurry supply 108 to initiate slurry dispense. The control unit 120 may be comprised of two or more sub units that may communicate with appropriate communications networks, such as cable connections, wireless networks and the like. For instance, the control unit 120 may comprise a sub control unit as is provided in conventional CMP systems to appropriately provide control signals 121, 122 and 123 to the drive assemblies 105, 103 and 112, respectively, to coordinate the movement of the polishing head 104, the polishing pad 102 and the pad conditioner 110. The control signals 121, 122 and 123 may represent any suitable signal form to instruct the corresponding drive assemblies to operate at the required rotational and/or translatory speeds.

In one embodiment, the control unit 120 is configured to receive a seismic signal 131 from the seismic sensor 130 and to display and/or process the seismic signal 131 as will be described later on.

In particular embodiments, the control unit 120 may further be configured to receive and process a signal 124 from the drive assembly 112 or a probe having a contact surface (not shown), which basically indicates a frictional force acting between the polishing pad 102 and the conditioning member 113 or the contact surface of the probe during operation. The signal 124 may also be referred to as a "torque" signal. The ability of receiving and processing the seismic signal 131 and/or the torque signal 124 may be implemented in the form of a corresponding sub unit, a separate control device, such as a PC, or as part of a facility management system. Data communication to combine the conventional process control functions with the sensor signal processing may be obtained by the above communications networks.

During the operation of the CMP system 100, the substrate 107 may be loaded onto the polishing head 104, which may have been appropriately positioned to receive the substrate 107 and convey it to the polishing pad 102. It should be noted that the polishing head 104 typically comprises a plurality of gas lines supplying vacuum and/or gases to the polishing head 104 to fix the substrate 107 and to provide a specified down force during the relative motion between the substrate 107 and the polishing pad 102.

The various functions required for properly operating the polishing head 104 may also be controlled by the control unit 120. The slurry supply 108 is actuated, for example, by the control unit 120, to supply the slurry 109 that is distributed across the polishing pad 102 upon rotating the platen 101 and the polishing head 104. The control signals 121 and 122 supplied to the drive assemblies 105 and 103, respectively, effect a specified relative motion between the substrate 107 and the polishing pad 102 to achieve a desired removal rate, which depends, as previously explained, on the characteristics of the substrate 107, the construction and current status of the polishing pad 102, the type of slurry 109 used, the down force applied to the substrate 107, etc. Prior to and/or during the polishing of the substrate 107, the conditioning member 113 is brought into contact with the polishing pad 102 to rework the surface of the polishing pad 102. To this end, the head 111 is rotated and/or swept across the polishing pad 102, wherein, for example, the control unit 120 provides the control signal 123 such that a substantially constant speed, for example, a rotational speed, is maintained during the conditioning process. Depending on the status of the polishing pad 102 and the conditioning surface of the member 113, for a given type of slurry 109, a frictional force acts and requires a specific amount of motor torque to maintain the specified constant rotational speed.

Contrary to the frictional force acting between the substrate 107 and the polishing pad 102, which may significantly depend on substrate specifics and may, therefore, greatly vary during the polishing process of a single substrate, the frictional force between the conditioning member 113 and the polishing pad 102 is substantially determined by the status of the polishing pad 102, the conditioning member 113 and other consumables. For instance, during the progress of the conditioning process for a plurality of substrates 107, a sharpness of the surface texture of the conditioning member 113 may deteriorate, which may lead to a decrease of the frictional force between the pad 102 and the conditioning member 113. Consequently, the motor torque and thus the motor current required to maintain the rotational speed constant also decreases. Thus, the value of the motor torque conveys information on the frictional force and depends on the status at least of the conditioning member 113.

Without restricting the present invention to the following discussion, it is believed that the interaction of the conditioning member 113 and the polishing pad 102 leads to mechanical vibrations, wherein one or more characteristics, such as the amplitude or the frequency, may be correlated to the status of a consumable of the system 100. For example, a sharp conditioning surface may produce vibrations of increased amplitude at low frequencies and/or may generate vibrations of reduced amplitude at higher frequencies compared to a degraded conditioner. Therefore, the information, contained in the seismic signal 131, with regards to vibrations in the pad 102 and/or the conditioner 110 or any other additional probe, may be used to assess the status of the pad 102, the conditioner 110 or other consumables. Since the interaction between the pad 102 and the member 113 is also reflected in the torque signal 124, it may convey information on the average magnitude of the amplitude of these vibrations due to the mechanical inertia of the drive assembly 112. Hence, in particular embodiments, the torque signal 124 and the seismic signal 131 may be used in combination to assess the status of consumables in the system 100, wherein the sensor signal substantially may represent the frictional force and an averaged amplitude of vibrations while the seismic signal 131 provides timely "highly resolved" information, such as the frequency of vibrations, thereby enhancing the accuracy in estimating the status of the system 100 compared to only using the seismic signal 131.

The seismic signal 131 and, in some embodiments, additionally the torque signal 124, for example representing the motor torque or motor current, are received by the control unit 120 and are processed to estimate the current status of at least the conditioning member 113. Thus, in one embodiment of the present invention, the frequency and amplitude, possibly in combination with the motor torque, may represent a characteristic of the conditioning member 113 to estimate the current status thereof. In other embodiments, the seismic signal 131 may indicate the status of other consumables, such as the status of the polishing pad 102.

Upon receiving and processing the seismic signal 131 and/or the torque signal 124, for example comparing with a threshold value, the control unit 120 may then indicate whether or not the current status of the conditioning member 113 is valid, i.e., is considered appropriate to provide the desired conditioning effect. Moreover, in other embodiments, the control unit 120 may estimate the remaining lifetime of the conditioning member 113, for example by storing previously obtained frequency values and motor torque values and interpolating these values for the further conditioning time on the basis of appropriate algorithms, and/or on the basis of reference data previously obtained, as will be described in more detail with reference to FIGS. 2*a* and 2*b*.

Figure 2A:
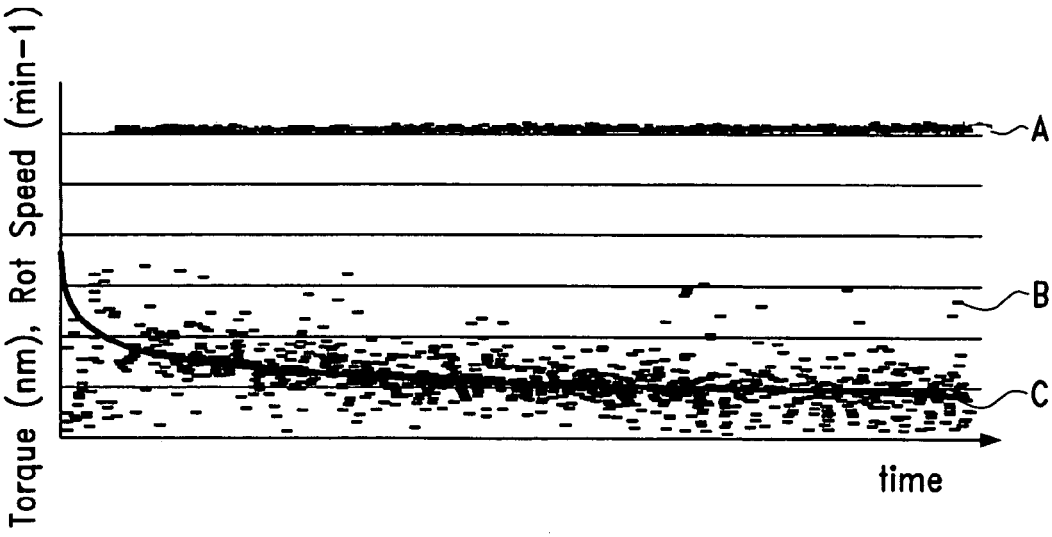
FIG. 2*a* shows a graph illustrating measurement values for the motor current of a conditioner drive assembly versus the conditioning time.

FIG. 2*a* schematically depicts a graph representing typical measurement values of the torque signal 124, representing a motor current, over time, wherein the drive assembly 112 is controlled to maintain a substantially constant speed of the member 113. The measurement values, indicated by A, represent the rotational speed of the member 113, while the values represented by B are the motor current values. The signal 124 appears to be fairly "noisy," indicating the presence of mechanical vibrations caused by the interaction of the member 113 and the pad 102. It should be noted that the vibrations may significantly be influenced by the control strategy used in controlling the drive assembly 112. That is, for example, a low inertia drive assembly with a fast-responding drive control circuitry may create vibrations of higher frequency compared to a "slower" drive assembly. From the "noisy" signal 124, a corresponding averaged signal may be obtained, as is indicated as curve C in FIG. 2*a*, which represents a "long term" correlation of the status of the system 100 to the torque signal 124.

Figure 2B:
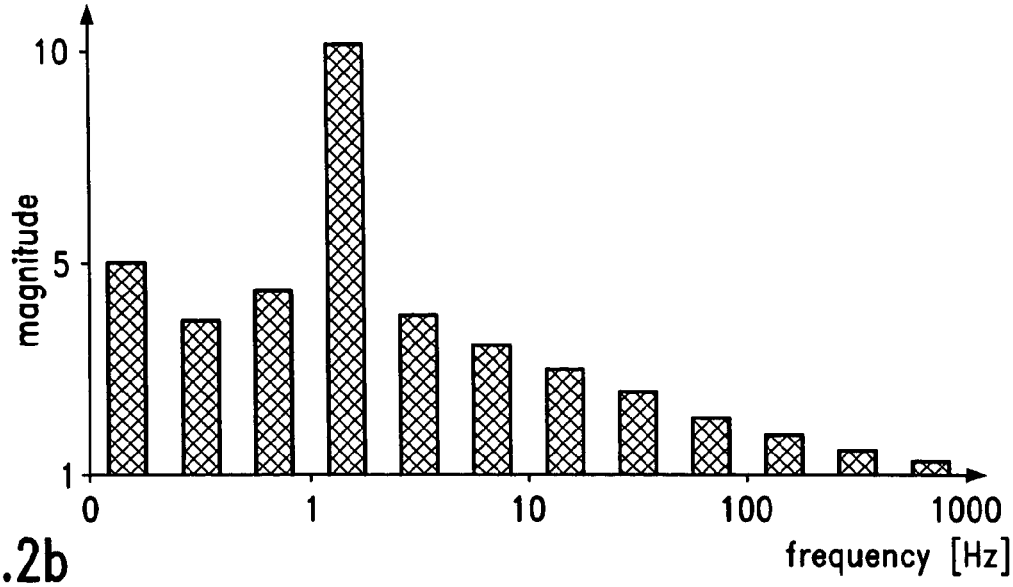
FIG. 2*b* illustrates in a schematic manner the frequency component of a seismic signal versus the amplitude according to one embodiment of the present invention.

FIG. 2*b* schematically represents a qualitative progression of the seismic signal 131, which in the present case represents the magnitude of frequency components of vibrations detected by the seismic sensor 130. In other examples, the amplitude and frequency and/or the temporal change of the amplitude and/or the acceleration of the vibrational movement of one or more frequency components may be used for assessing the status of the system 100. Moreover, the seismic signal 131 may represent one or more spatial components of the vibrations detected. That is, the seismic sensor 130 may be configured to detect the vibrations in one, two or three dimensions. For example, the vertical component of the vibrations may be used as the seismic signal 131. In FIG. 2*b*, the magnitude of frequency components may indicate a specified status of the system for a given time or, when the seismic signal 131 is averaged over a certain moderately short time interval, on a shorter time scale compared to, for instance, the gradual deterioration of the polishing pad 102 and/or the conditioning surface of the member 113, as indicated by curve C in FIG. 2*a*. For instance, the pronounced magnitude of the frequency component at approximately 2 Hz in FIG. 2*b* may indicate the presence of a bubble in the polishing pad 102, which may be detected twice every second for a rotational speed of 120 rounds per minute of the polishing pad 102. Thus, the magnitude of the 2 Hz frequency component may imply a deterioration of the pad 102, and suggest the replacement of the pad 102. It should be appreciated that FIG. 2*b* may show a significantly different progression depending on the specifics of the system 100, the seismic sensor 130 used, the signal processing applied to the seismic signal 131 and the like. However, due to the sensitivity to mechanical vibrations within a wide frequency and amplitude range, an enhanced "resolution" in the sensitivity for changes of the status of the CMP system 100 may be achieved. The seismic signal 131 may then advantageously be combined with the torque signal 124 to further increase the accuracy of the assessment. For example, frequency and/or amplitude values obtained from the seismic sensor 130 may be correlated to the status of the member 113 as one example of a consumable by inspecting the member 113 on a regular basis so that these values may be used as reference data. Similarly, the status of the member 113 may also be assigned to corresponding values of the torque signal 124, which may then also be used as corresponding reference data. The assessment of a currently used member 113, that is, the conditioning surface thereof, may then be carried out on the basis of both reference data, thereby increasing the reliability of the assessment.

It should be appreciated that the information contained in the seismic signal 131 and the torque signal 124 may be combined in any appropriate manner in addition to or alternatively to individually providing respective reference data for these signals. For example, the seismic signal may represent the magnitude of a specified frequency component or an averaged magnitude of a specified frequency range over time and both signals may be "folded" by superimposing the signals or any already pre-processed numerical representation thereof to obtain a single yet more accurate representation of the measurement values of the seismic signal 131 and the torque signal 124.

Figure 3A:
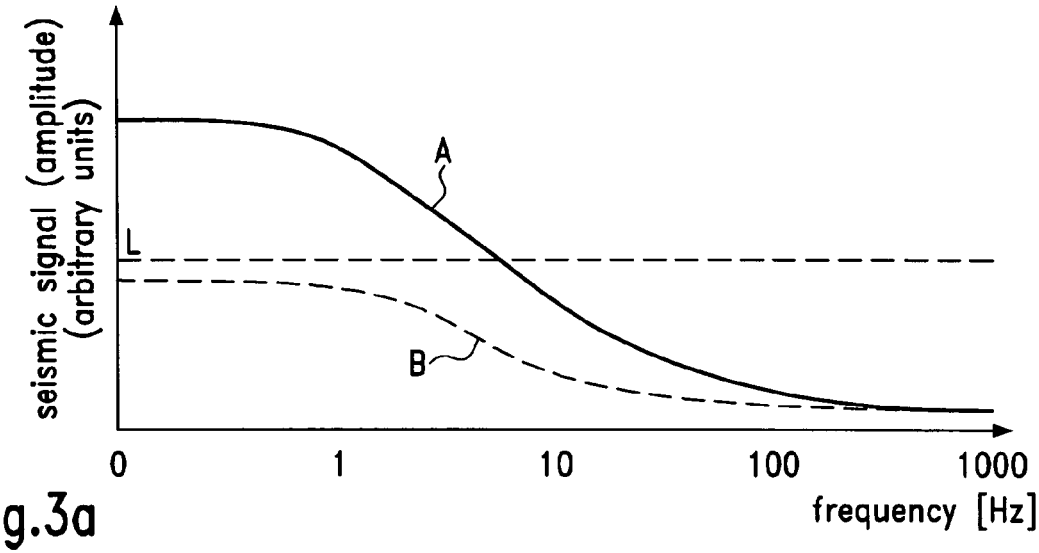
FIGS. 3*a* and 3*b* exemplarily depict the progression of seismic signals at different times for different frequency ranges according to illustrative embodiments of the present invention.
Figure 3B:
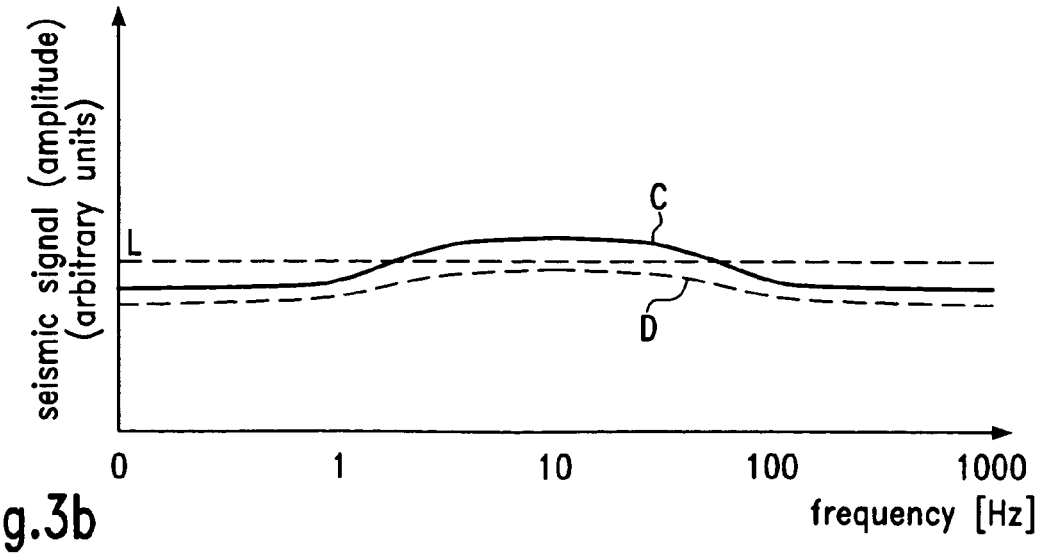
Figure 4:
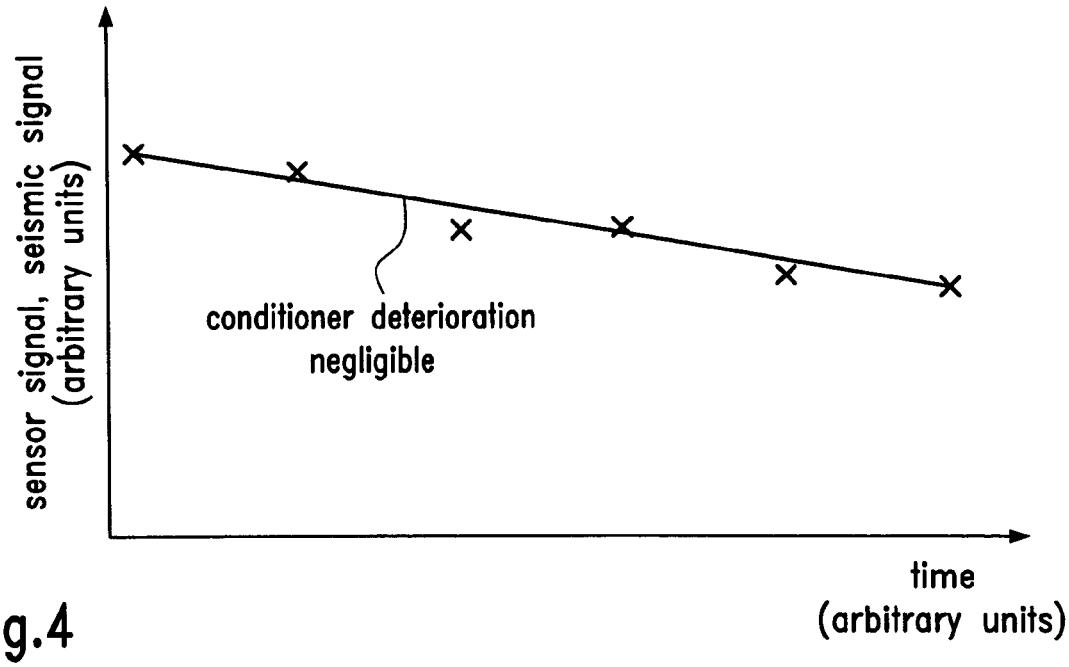
FIG. 4 represents a plot of sensor signal, representing a seismic signal and a torque signal versus time, while polishing a substrate under substantially stable conditioning conditions.
Figure 5:
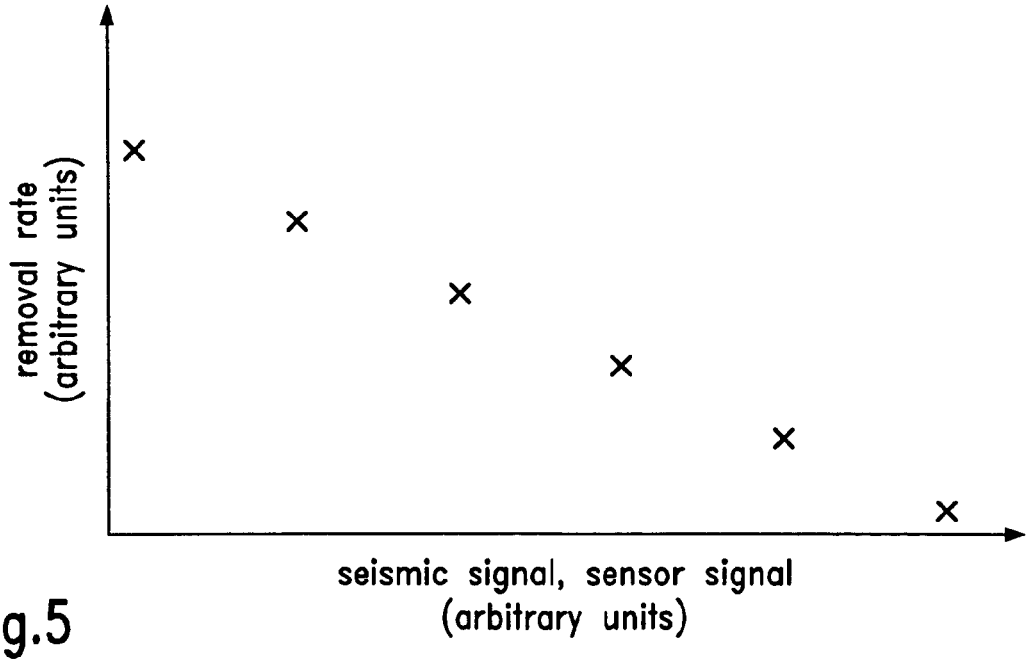
FIG. 5 schematically shows a graph depicting the dependence of a specified characteristic of a conditioning surface, for example represented by a removal rate obtained by conditioning a polishing pad under predefined operating conditions, versus the sensor signal.

With reference to FIGS. 3–5, further illustrative embodiments will now be described, wherein it is referred to as a sensor signal, which is to represent the seismic signal 131 or a combination of the seismic signal 131 and the torque signal 124. In these drawings, schematic and qualitative representations of the sensor signal are provided to demonstrate the principles of various process strategies. Based on the teaching provided with reference to these drawings, a corresponding process control may readily be established for actual measurement signals, since the form of these signals may depend on the specifics of the CMP tools and the seismic sensor elements used.

FIGS. 3*a*–3*b* schematically show graphs illustrating the dependence of a sensor signal, such as the seismic signal 131 from the conditioning time for specified operating conditions of the CMP system 100. Under specified operating conditions, it is meant that a specified type of slurry 109 is provided during the conditioning process, wherein the rotational speed of the platen 101 and that of the head 111 are maintained substantially constant. Moreover, in obtaining representative data or reference data for the motor current, the CMP system 100 may be operated without a substrate 107 to minimize the dependence of pad deterioration for estimating the status of the conditioning member 113. In other embodiments, a product substrate 107 or a dedicated test substrate may be polished to thereby simultaneously obtain information on the status of the polishing pad 102 and the conditioning member 113, as will be explained later on.

FIG. 3*a* shows the seismic signal 131 as one candidate for the sensor signal, for two different conditioning members 113 with respect to a specified conditioning time or time interval. As indicated, the measurement values may be obtained for discrete frequency components or may be illustrated in a substantially continuous manner, depending on the capability of the control unit 120 in processing the sensor signal. In other embodiments, smooth measurement curves may be obtained by interpolating or otherwise employing fit algorithms to discrete measurement values.

In FIG. 3*a*, curves A, B represent the respective sensor signals of the two different conditioning members 113, wherein, in the present example, it is assumed that the curves A and B are obtained with polishing pads 102 that may frequently be replaced to substantially exclude the influence of pad deterioration on the measurement results. Curve A represents a conditioning member 113 producing an increased magnitude or amplitude of low frequency components at the specified conditioning time compared to the conditioning member 113 represented by the curve B. Thus, the frictional force and, hence, the conditioning effect of the conditioning member 113 represented by curve A may be higher than the conditioning effect provided by the conditioning member 113 represented by curve B. The dashed line, indicated as L, may represent the minimum magnitude and, thus, the minimum conditioning effect that is at least required to provide what is considered to be sufficient to guarantee process stability during polishing the substrate 107. Consequently, the useful lifetime of the conditioning member 113 represented by the curve B has ended and the member 113 should be replaced. Moreover, from the difference of curve A and the limit L, the remaining lifetime of the member 113 represented by curve A may be estimated, for example, on the basis of respective reference data and the like. In case the curves A and B are obtained by simultaneously polishing actual product substrates 107, the control unit 120 may indicate an invalid system status once the corresponding curves reach the limit L.

FIG. 3*b* shows a similar case, wherein curves C and D represent corresponding members 113 at a specified time or over a certain time interval, wherein contrary to FIG. 3*a* a higher frequency range is used to assess the status of the system 100. In this case, an increase of the magnitude of the frequency components of interest may indicate a deterioration of the respective member 113. For instance, curve C may represent the member 113 that has deteriorated so as to exceed a limit L, while the deterioration of the member 113, represented by curve D, remains below the limit L, thereby indicating that at the time curves C and D have been obtained, the member 113 represented by curve C has exceeded its useful lifetime.

It should be noted that the illustrations in FIGS. 3*a* and 3*b* are illustrative only and any other representation may be used. For instance, instead of depicting the magnitude of frequency components for a plurality of frequencies, the progression of a specified frequency or frequency range may be plotted over time to more conveniently be able to extract the current status and the remaining useful lifetime of one or more consumables of the system 100.

Hence, in other embodiments, the remaining lifetime of the conditioning member 113 may be predicted by the control unit 120 on the basis of the sensor signal in that the preceding progression of the sensor signal is assessed and used to interpolate the behavior of the corresponding curve in the future. Assume, for example, that the sensor signal represents a time-dependent progression, and at a time point $t_p$, a prediction regarding the remaining lifetime of the conditioning member 113 is requested, for instance, to coordinate the maintenance of various components of the CMP system 100, or to estimate the tool availability when establishing a process plan for a certain manufacturing sequence. From the preceding progression and slope of the sensor signal, the control unit 120 may then determine, for example by interpolation, a reliable estimation of a difference between $t_p$ and a time point when crossing the limit L is to be expected, thereby determining the remaining useful life of the conditioning member 113. The prediction of the control unit 120 may further be based on the "experience" of other curves having a very similar progression during the initial phase $t_P$. To this end, a library of curves representing the sensor signal may be generated, wherein the sensor signal is related to the corresponding conditioning time for specified operating conditions of the CMP system 100. By using the library as reference data, the reliability of the predicted remaining lifetime gains in consistency with an increasing amount of data entered into the library. Moreover, from a plurality of representative curves, an averaged behavior of the further development at any given time point may be established to further improve the reliability in predicting a remaining lifetime of the conditioning member 113.

As previously pointed out, the frictional force and the mechanical vibrations may also depend on the current status of the polishing pad 102, and thus the deterioration of the polishing pad 102 may also contribute to the progression of the sensor signal over time. Since the polishing pad 102 and the conditioning member 113 may have significantly different lifetimes, it may be advantageous to obtain information on the status of both the conditioning member 113 and the polishing pad 102 to be able to separately indicate a required replacement of the respective component. Hence, in one illustrative embodiment of the present invention, a relationship is established between the sensor signal, that is, in one example the seismic signal 131, over time with respect to the deterioration of the polishing pad 102. To this end, a specified CMP process, i.e., a predefined CMP recipe, may be performed for a plurality of substrates, wherein the conditioning member 113 is frequently replaced to minimize the influence of deterioration of the conditioning member 113 on the measurement results.

FIG. 4 schematically illustrates, in an exemplary manner, the sensor signal obtained over time, indicating a decreasing frictional force, a corresponding change of specified frequency components of vibrations, a change of amplitudes of the vibrations, and the like, for the conditioning member 113 and the polishing pad 102, wherein it may be assumed that the reduction of the conditioning effect may substantially be caused by an alteration of the surface of the polishing pad 102. In the present example, the pad deterioration may result in a slight decrease of the motor current signal or the frequency, whereas in other CMP processes a different behavior may result. It should be noted that any type of signal variation of the sensor signal may be used to indicate the status of the polishing pad 102 as long as an unambiguous, that is, a substantially monotonous, behavior of the sensor signal over time, at least within some specified time intervals, is obtained. As previously pointed out with reference to FIG. 3*a*, a plurality of polishing pads 102 and a plurality of different CMP processes may be investigated to establish a library of reference data or to continuously update any parameters used in the control unit 120 for assessing the current status of consumables of the CMP system 100.

In one illustrative embodiment, the measurement results exemplarily represented in FIG. 4 may be combined with the measurement data of FIGS. 3*a* and 3*b*, thereby enabling the control unit 120 to estimate the remaining useful lifetime of both the polishing pad 102 and the conditioning member 113. For instance, the control unit 120 may be adapted to precisely monitor time periods when the polishing pad 102 and the conditioning member 113 are used. From the measurement results in FIGS. 3*a* and 3*b*, when provided as, for instance, a time-dependent progression of a frequency component or range of interest, thereby representing the deterioration of the conditioning member 113 substantially without the influence of any pad alterations, a slightly enhanced decrease of the sensor signal may then to be expected owing to the additional reduction of the sensor signal caused by the additional deterioration of the polishing pad 102. Thus, an actual sensor signal, i.e., the seismic signal 131 or the seismic signal 131 in combination with the torque signal 124, obtained during the polish of a plurality of substrates without replacing the conditioning member 113 and the polishing pad 102, may result in similar curves except for a somewhat steeper slope of these curves over the entire lifetime. Thus, by comparing actual sensor signals with representative curves such as discussed with reference to FIGS. 3*a*–3B, and with representative curves such as those shown in FIG. 4, a current status of both the polishing pad 102 and the conditioning member 113 may be estimated.

Moreover, the sensor signal may also be recorded for actual CMP processes and may be related to the status of the consumables of the CMP system 100 after replacement, to thereby enhance the "robustness" of the relationship between the sensor signal and the current status of a consumable during actual CMP processes. For instance, the progression of a specified sensor signal may be evaluated after the replacement of the conditioning member 113, which may have been initiated by the control unit 120 on the basis of the considerations explained above, wherein the actual status of the conditioning member 113 and possibly of other consumables, such as the polishing pad 102, are taken into consideration. If the inspection of the conditioning member 113 and possibly of other consumables indicates a status that is not sufficiently correctly represented by the sensor signal, for example, the limit L in FIGS. 3*a* and 3*b* may correspondingly be adapted. In this way, the control unit 120 may continuously be updated on the basis of the sensor signal.

With reference to FIG. 5, further illustrative embodiments of the present invention will now be described, wherein the control unit 120 additionally or alternatively includes the function of controlling the CMP process on the basis of the sensor signal. As previously explained, the deterioration of one of the consumables of the CMP system 100, for instance of the conditioning member 113, may affect the performance of the CMP system 100, even if the usable lifetime is still in its allowable range. In order to obtain a relationship between the performance of the CMP system 100 and the sensor signal, for instance provided in the form of the seismic signal 131 and the torque signal 124, one or more representative parameters may be determined in relation to the sensor signal. In one embodiment, a global removal rate for a specified CMP recipe may be determined with respect to the corresponding sensor signal obtained from the seismic sensor 130 and from drive assembly 112. To this end, one or more test substrates may be polished, for example intermittently with product substrates, to determine a removed thickness of a specified material layer. Concurrently, the corresponding sensor signal is recorded. The test substrates may have formed thereon a relatively thick non-patterned material layer to minimize substrate-specific influences.

FIG. 5 schematically shows a plot qualitatively depicting the dependence of the removal rate for a specified CMP recipe and a specified material layer from the frequency response and/or the motor current as one example of the sensor signal. From the measurement data, a corresponding relationship between the sensor signal and the CMP specific characteristic may then be established. That is, in the example shown in FIG. 5, each measurement value represents a corresponding removal rate of the CMP system 100. This relationship may then be implemented in the control unit 120, for instance in the form of a table or a mathematical expression and the like, to control the CMP system 100 on the basis of the sensor signal. For example, if a sensor signal is detected by the control unit 120 indicating a decrease of the removal rate of the CMP system 100, the control unit 120 may instruct the polishing head 104 to correspondingly increase the down force applied to the substrate 107. In other cases, the relative speed between the polishing head 104 and the polishing pad 102 may be increased to compensate for the decrease of the removal rate. In a further example, the total polish time may be adapted to the currently prevailing removal rate indicated by the sensor signal.

In other embodiments, representative characteristics of the CMP system 100 other than the removal rate may be related to the sensor signal. For instance, the duration of the polishing process, i.e., polish time, may be determined for a specified product or test substrate and may be related to the sensor signal as received during the polish time for the specific substrate so that, in an actual CMP process, the sensor signal obtained by the control unit 120 may then be used to adjust the polish time based on the determined relation for the currently processed substrate. Consequently, by using the sensor signal alternatively or in addition to estimating the status of consumables, the process control may be carried out on a run-to-run basis, thereby significantly enhancing process stability. In other embodiments, the sensor signal may also be used as a status signal representing not only the status of one or more consumables but also the currently prevailing performance of the CMP system 100, wherein this status signal may be supplied to a facility management system or to a group of associated process and metrology tools to thereby improve the control of a complex process sequence by commonly assessing the status of the various process and metrology tools involved and correspondingly adjusting one or more process parameters thereof. For instance, a deposition tool may be correspondingly controlled on the basis of the sensor signal to adapt the deposition profile to the current CMP status. Assume that, a correlation between the sensor signal and the polishing uniformity across a substrate diameter may have been established which may be especially important for large diameter substrates having a diameter of 200 or 300 mm. The information of the sensor signal is then used to adjust the process parameters of the deposition tool, such as an electroplating reactor, to adapt the deposition profile to the currently detected polishing non-uniformity.

As a result, the present invention provides a system and a method for enhancing the performance of a CMP system or of a process tool chain including a CMP system, since a seismic signal provided by a seismic sensor that detects vibrations in a polishing pad and/or a pad conditioner is used to detect or at least estimate the current status of one or more consumables and/or the current performance status of the CMP system. Based on this seismic signal, an invalid system status and/or a remaining lifetime may be indicated and/or the control of the CMP process may be based, among other things, on the seismic signal. The estimation of the status of the consumables, e.g., by predicting the remaining lifetime, allows the coordination of maintenance periods for different CMP components and/or different CMP related process tools. The seismic signal or the information contained therein may be combined with a torque signal or the information contained therein to enhance the reliability of the process control. Thus, the cost of ownership, due to a more efficient usage of consumables, is reduced while tool availability is enhanced. Using the seismic signal and the torque signal, which may be supplied by a pad conditioner drive assembly and a seismic sensor attached thereto, also improves the process stability in that CMP specific variations may be compensated for within the CMP tool and/or at one or more process tools downstream or upstream of the CMP tool.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system for chemical mechanical polishing, comprising:

a controllably movable polishing head configured to receive and hold in place a substrate;

a polishing pad mounted on a platen that is coupled to a drive assembly;

a pad conditioning assembly;

a vibration sensor disposed to detect a vibration in at least one of said polishing pad and said pad conditioning assembly, said vibration sensor being configured to supply a vibration signal indicative of at least a frequency of said vibration; and a control unit operatively connected to said vibration sensor and operable to receive a friction signal distinct from said vibration signal, wherein said control unit is configured to provide an indication of at least one characteristic of a consumable member of said system based on a combination of said friction signal and said vibration signal.

2. The system of claim 1, wherein said vibration sensor is attached to said pad conditioning assembly.

3. The system of claim 1, further comprising a probe having a contact surface that is configured to be brought into contact with said polishing pad.

4. The system of claim 3, wherein said probe is represented by at least one motor of said pad conditioning assembly and said contact surface is represented by a conditioning surface of said pad conditioning assembly.

5. The system of claim 3, wherein said probe is configured to provide said friction signal indicative of a frictional force between said polishing pad and said contact surface.

6. The system of claim 1, wherein said vibration sensor comprises at least one of an acceleration sensor, a speed sensor, and a pressure sensor.

7. The system of claim 3, wherein said vibration sensor is attached to said probe.

8. The system of claim 1, further comprising a probe having a contact surface that is configured to be brought into contact with said polishing pad, said probe being configured to provide a torque signal indicative of a frictional force between said contact surface and said polishing pad as the friction signal.

9. The system of claim 8, wherein said probe is represented by at least one motor of said pad conditioning assembly and said contact surface is represented by a conditioning surface of said pad conditioning assembly.

10. The system of claim 9, wherein said torque signal is indicative of at least one of a revolution of said at least one motor and a torque of said at least one motor.

11. The system of claim 1 wherein said control unit is further configured to control at least one of said drive assembly and said polishing head on the basis of said vibration signal.

12. The system of claim 8, wherein said control unit is further configured to control at least one of said drive assembly and said polishing head on the basis of said torque signal and said vibration signal.

13. The system of claim 1, wherein said vibration signal is indicative of a magnitude of said vibration and a frequency of said vibration.

* * * * *